US005449247A

United States Patent [19]

Smith

[11] Patent Number: 5,449,247

[45] Date of Patent: Sep. 12, 1995

[54] BOAT MOORING STATION

[76] Inventor: Delbert G. Smith, 8411 N. Bayway, Cheboygan, Mich. 49721

[21] Appl. No.: 194,028

[22] Filed: Feb. 9, 1994

Related U.S. Application Data

[63] Continuation-in-part of Ser. No. 935,788, Aug. 27, 1992, abandoned.

[51] Int. Cl.[6] ..... B63C 1/00

[52] U.S. Cl. ..... 405/3; 405/7

[58] Field of Search ..... 405/1, 3, 4, 7, 218, 405/221; 114/44, 45, 48; 414/678

[56] References Cited

U.S. PATENT DOCUMENTS

| | | | |
|---|---|---|---|
| 3,753,355 | 8/1973 | Knoch | 61/65 |
| 4,019,212 | 4/1977 | Downer | 9/1.5 |
| 4,022,027 | 5/1977 | Tetzner | 61/65 |
| 4,037,421 | 7/1977 | Whitley, Jr. | 61/65 |
| 4,944,633 | 7/1990 | Robb | 405/3 |
| 5,067,428 | 11/1991 | Dickerson et al. | 114/230 |
| 5,163,378 | 11/1992 | Raymond | 114/44 |
| 5,186,576 | 2/1993 | Fournier | 405/7 |

*Primary Examiner*—David H. Corbin

*Attorney, Agent, or Firm*—Price, Heneveld, Cooper, DeWitt & Litton

[57] ABSTRACT

A boat mooring station comprises frame members connected to define a mooring station frame. The mooring station frame is positioned above a waterline of a body of water and oriented generally parallel to the surface of the body of water. An extensible front leg is connected with the frame near a front end and a pair of back legs are connected with the frame near a back end. The back legs extend at least generally downward to stand on a bottom of the body of water and support the frame. The front leg extends to raise the mooring station front to a launch position for launching or receiving a boat and retracts to lower the mooring station front to a storage position for storing the boat. The mooring station includes a boat support connected with the frame to receive and support the boat. The boat engages the boat support and moves upon the boat support relative to the frame, preferably on rollers, whereby the boat is lifted from a floating position to the storage position upon the boat support and whereby the boat is lowered from the storage position to the floating position. The boat support has one part located near the back of the mooring station and has another part located between the one part and the front of the mooring station.

18 Claims, 3 Drawing Sheets

BOAT MOORING STATION

CROSS-REFERENCES TO RELATED APPLICATIONS

This is a continuation-in-part of U.S. patent application Ser. No. 07/935,788, entitled BOAT MOORING STATION and filed on Aug. 27, 1992 by Delbert G. Smith, now abandoned, the disclosure of which is incorporated here by reference.

BACKGROUND OF THE INVENTION

This invention relates in general to a boat mooring station, and in particular to a boat mooring station upon which a floating boat is moved to lift the boat out of the water for safe storage.

The inventor, having over 20 years experience in the marine industry, has observed that very little improvement has been made in the area of mooring stations. Desired traits that existing mooring stations fail to provide are to be simple, inexpensive, easily movable, easily disassembled for portability, and have the ability to safely raise the boat out of the water.

The problems of improper on-water storage of boats accounts for a considerable amount of damage. Existing systems that do lift the boat above the water are typically heavy, complicated to assemble, burdensome to transport, and difficult to position in and remove from the water. The common "boat lift" station has been around for many years. This type of "boat lift" has four (4) corner posts that support a platform that is raised or lowered by use of pulleys and cable actuated by a turning wheel. The platform has padded rails that lift the boat once it has been floated over them. Such boat lifts provide good protection, but are very heavy, are complicated to assemble, lack portability, and are limited to a narrow range of water depth in which it can function.

The inventor has seen several attempts to achieve adequate boat mooring. These systems usually provide some degree of boat containment that leaves the boat subject to damage by high wave action. In many cases the damage results from the boat beating against the mooring station itself. Further, the inventor is unaware of any prior boat mooring station design that can be adapted to boats from 12 feet to over 24 feet in length, is lightweight for easy positioning, offers a high degree of portability, lifts the boat above the waterline, and is easy to assemble. Such a mooring station is badly needed in this time of limited and expensive marina dockage space.

Dickerson et al., U.S. Pat. No. 5,076,428, is an example of a containment style mooring station. Typically, some kind of telescoping legs to adjust to varying water depths is used. Also, padded boards are used to contain the bow of the boat. The main problem with this style is that it does not lift the boat out of the water, but only confines a floating boat. High wave action is likely to cause the boat to ride up onto the pads or beat down on the station, either of which can cause severe hull damage.

This inventor's mooring station solves all of these problems. The invention is lightweight for portability, easy to assemble and disassemble, lifts the boat out of the water for protection, can be used in a wide range of water depths and shoreline conditions, and can be adapted to boats from 12 feet to over 24 feet in length.

SUMMARY OF THE INVENTION

The invention addresses the failings of prior mooring stations, as discussed above, with a clever boat mooring station comprising rollers and a winch mounted on a corrosion resistant lightweight frame to pull a boat up and out of the water to safe storage on top of the rollers. This invention is also adaptable to varying water depths and shoreline conditions, lightweight for easy positioning, easily disassembled and reassembled for portability to multiple locations, and adaptable for use with boats from 12 feet to over 24 feet in length.

The frame may be of aluminum channel which is lightweight and will not corrode. The rear legs are adjustable in length to adapt to varying water depths. The front of the mooring station has an adjustable length front leg to raise or lower the front of the frame. The roller system includes rollers mounted on tilting arms so the rollers adjust to varying hull bottom shapes. The winch to pull the boat onto the rollers is mounted on a stand that is attached at the front of the frame.

To use this mooring station, the bow of the boat is floated up to the rear of the frame and the winch cable is hooked onto the boat's bow eye. The winch is then activated to retrieve the cable which pulls the boat forward onto the rollers, sliding the boat relative to the mooring station frame. The adjustable rear legs are set so the rollers are just above waterline to lift the boat up and out of the wave action. The front leg is lowered to level the frame during storage. To launch the boat back into the water, the cable is disconnected, the front jack stand is raised to tilt the station, and the boat is pushed backwards to start it rolling backwards off the rollers and into the water.

The mooring station can be broken down into multiple, easy to transport sections by removing fourteen (14) bolts. This ease of portability is a major advantage for people who frequent many boating locations.

These and other features, objects, and benefits of the invention will be recognized by those who practice the invention and by those skilled in the art, from the specification, the claims, and the drawing figures.

DESCRIPTION OF THE PREFERRED EMBODIMENTS

Figures 1, 2:
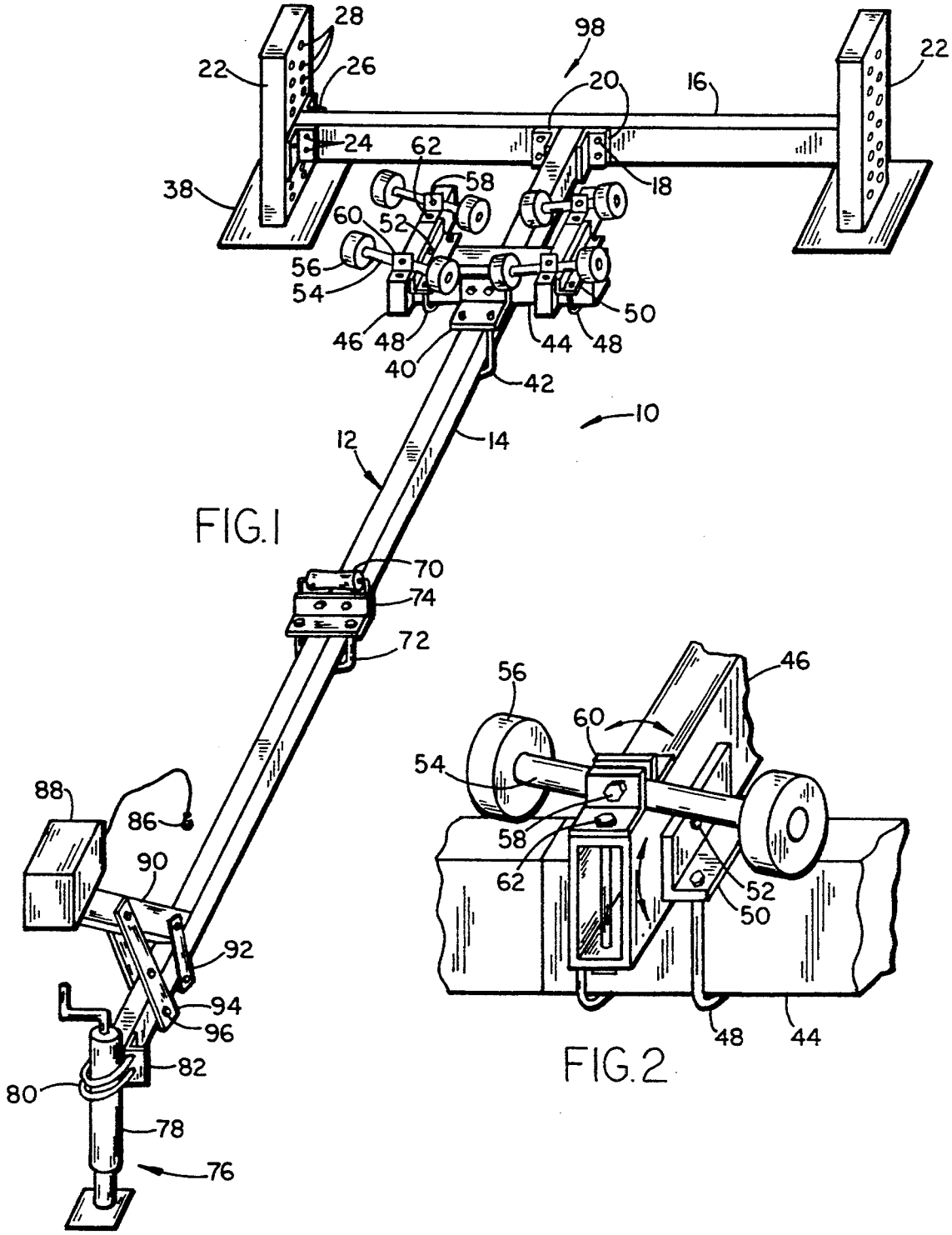
FIG. 1 is a perspective view of a preferred embodiment of a mooring station according to the invention.
FIG. 2 is an enlarged fragmentary perspective view detail of the roller tilt assembly.

Referring to the drawing figures and in particular to FIG. 1 in greater detail, a mooring station 10 according to the invention has a frame 12 with a lengthwise frame member 14 bolted to a rear cross frame 16 with bolts 18 and angle brackets 20. Most preferably, each of lengthwise frame 14 and rear crossframe 16 is an aluminum rectangular tube or structural profile to provide a strong and lightweight frame for mooring station 10. Of course, those who are skilled in the art and those who practice the invention will realize that many other structural materials and configurations, including, but not limited to, plastics and other metals for example, will perform equally well. Further, while this description of preferred embodiments of a mooring station according to the invention typically discloses bolting components together, it shall be understood that other methods of connection, including, but not limited to, welding, screwing, and riveting for example, may also be used in the invention with equally good results.

Rear legs 22 are connected to each end of the rear cross frame 16 with bolts 24 and angle brackets 26. Rear legs 22 may be provided with a plurality of holes 28 along their length, or the coupling of legs 22 with frame 12 may otherwise be adapted by various commonly known methods, to couple legs 22 with frame 12 over a range of relative leg lengths to adjust to varying water depths.

Figure 3:
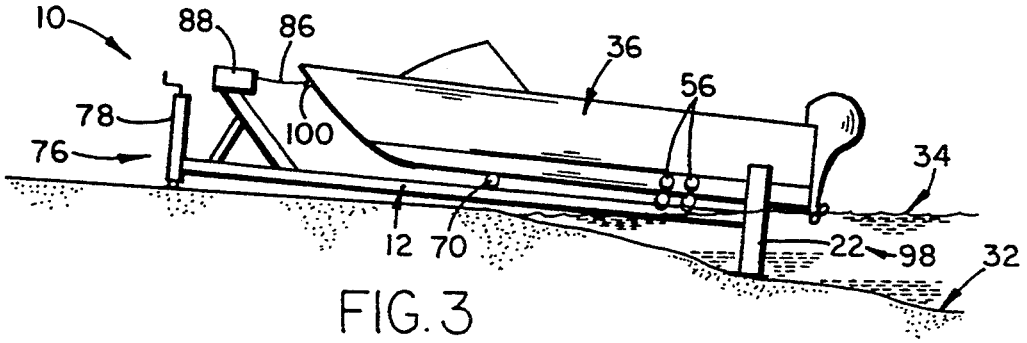
FIG. 3 is a side elevational view of the mooring station showing a boat in the loaded position.

The proper positioning of mooring station 10 is primarily dictated by local water conditions, but will most preferably locate a boat 36 just clear the water 34 in the storage position (FIG. 3). The maximum height of mooring station 10 is dictated by practical limitations, including access to the mooring station and the effort required to position the boat in the storage position, for example.

Leg support pads 38 are provided by conventional means on legs 22 so the weight of boat 36 will not force legs 22 to sink into the lake or river bottom 32 (FIGS. 1 and 3).

Angle brackets 40 and "U" bolts 42 attach a cross arm 44 to lengthwise frame member 14 (FIG. 1). A roller tilt arm 46 is attached to cross arm 44 with a "U" bolt 48, angle brackets 50, and a pivot pin 52 (FIGS. 1 and 2). Pivot pin 52 allows tilt arm 46 to tilt and adjust to the boat bottom in a lengthwise direction. Roller arm assemblies 54 with rollers 56 are in turn connected to tilt arm 46 with a pivot pin 58, angle brackets 60 and bolts 62. Pivot pin 58 allows roller arm assemblies 54 to tilt and conform to the hull bottom in a width-wise direction. The use of the "U" bolts 42, 48, described above, enables cross arm 44 and roller tilt arms 46 to slide to varying positions along lengthwise frame member 14 and tilt arm 46, respectively, to adjust for various boat bottom configurations.

A keel roller 70 (FIG. 1) is bolted to frame member 14 with a "U" bolt 72 and an angle bracket 74 so keel roller 70 may also be moved along frame member 14 and positioned to support the forward area of boat 36. At a front end 76 of mooring station 10, a length adjustable front leg or jack stand 78 is connected with lengthwise frame member 14 by "U" bolts 80 and angle brackets 82. Angle brackets 82 may be welded or otherwise securely fixed to longitudinal frame member 14.

Boat 36 is preferably pulled up onto mooring station 10 with a winch 88, having a cable and hook 86. A winch stand 90 is provided on longitudinal frame member 14 to support winch 88. Winch stand 90 may be bolted to longitudinal frame member 14 with straps 92 and 94 and bolts 96.

Figure 4:
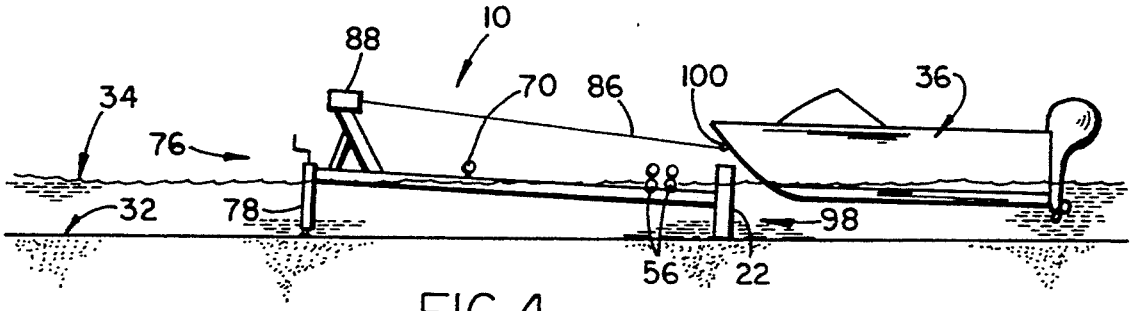
FIG. 4 is a another side elevational view of the mooring station showing an alternative shoreline condition and showing the boat in a floating position.

The process of storing boat 36 on mooring station 10 begins with floating boat 36 up to the back 98 of mooring station 10 (FIG. 4) and attaching winch cable and hook 86 to the bow eye 100, typically provided on boats for towing, anchoring, and the like. Winch 88 is actuated to retrieve cable and hook 86 and, in doing so, pull boat 36 up onto rollers 56. As boat 36 is pulled forward, it also contacts keel roller 70. When boat 36 is securely on all the rollers and the cable hook is about a foot from winch 88, boat 36 is positioned for storage. Front leg 78 is preferably adjusted to level mooring station 10, while boat 36 and its weight move forward. This makes it easier to operate the winch since the boat is not being pulled "uphill" when frame 12 is level or about parallel to the water surface.

To launch boat 36 back into the water, the sequence of mooring is generally reversed. Cable and hook 86 may be disconnected from bow eye 100 of boat 36 and front leg 78 extended from a storage position to a raised or launch position. In the storage position, front leg 78 is in a lowered position with mooring station 10 and frame 12 generally parallel to the water surface. In the raised or launch position, front leg 78 is extended and station front end 76 is raised relatively higher than mooring station back 98. With mooring station 10 in the launch position, a rearward push on boat 36 will roll the boat backward and down off of mooring station 10, to a floating position behind mooring station 10. As an alternative to disconnecting cable and hook 86, winch 88 may be set to allow cable and hook 86 to freely feed out. Of course, this variation and others will occur to those who are skilled in the art and to those who practice the invention.

The invention offers a high degree of portability since it is easily disassembled into several sections by disconnection at a limited number of releasable connections, namely, the four bolts 18 to separate lengthwise frame member 14 and cross frame 16. Further, removing the two "U" bolts 48 will separate cross arm 44 from frame member 14, while removing the two "U" bolts 80 separates front leg 78 from frame member 14, and removing the four bolts 96 will separate winch stand 90 from frame member 14. These sections may then be transported to another location and easily reassembled.

Figure 5:
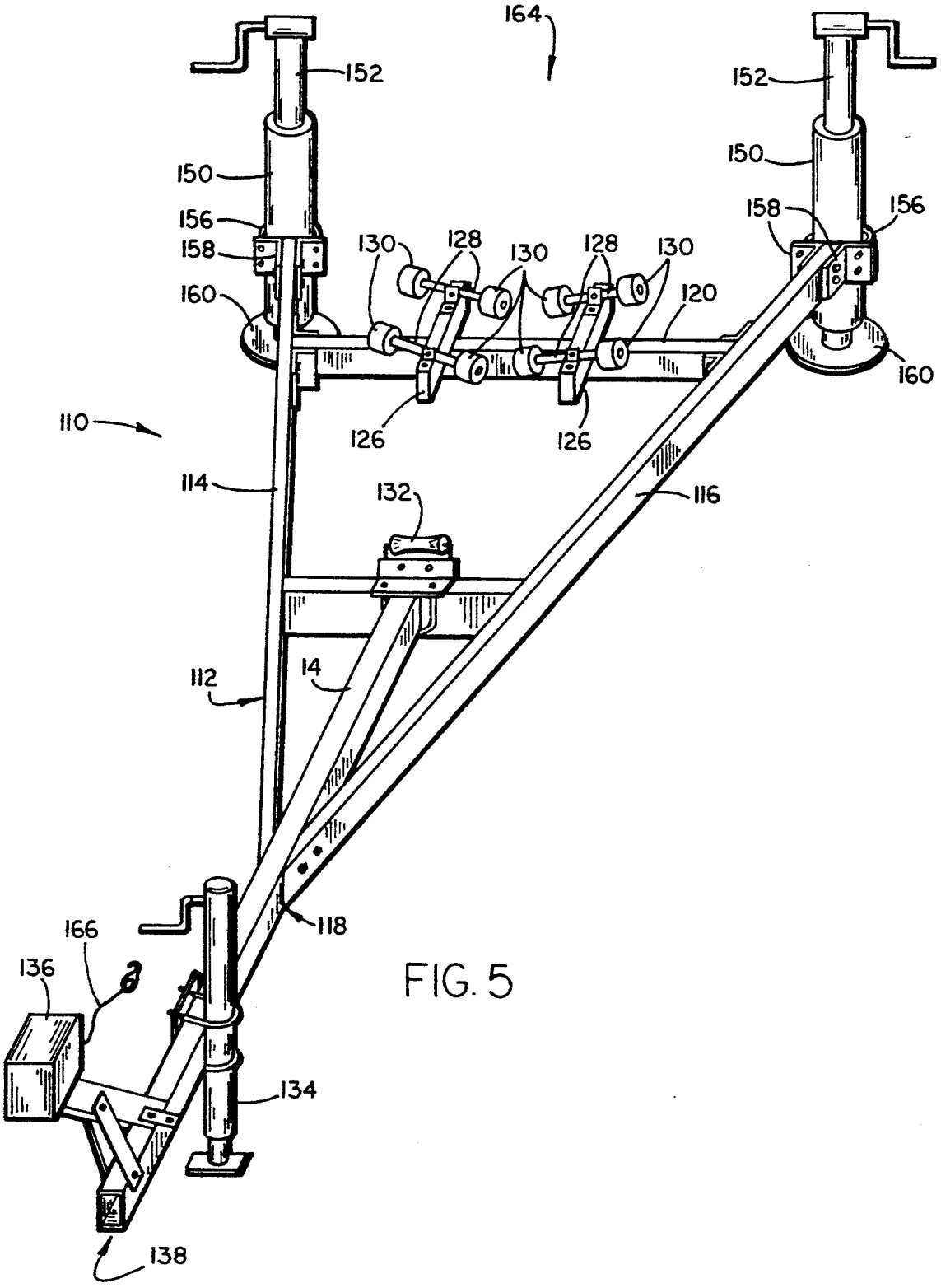
FIG. 5 is a perspective view of a first alternative embodiment of a mooring station according to the invention.

In an alternative embodiment 110 of mooring station 10, an A-shaped frame 112 (FIG. 5) is provided with a first longitudinal frame member 114 and a second longitudinal frame member 116 having their forward ends connected together at 118 and their back ends spaced apart with a crossframe member 120 extending at least between the two longitudinal frame members. As with mooring station 10 and frame 12 discussed above, the components of mooring station 110 and frame 112 are preferably connected with releasable couplings.

Similar to roller tilt arms 46, above, roller tilt arms 126 are pivotably mounted on crossframe member 120 and roller arms 128 are pivotably mounted on roller tilt arms to support rollers 130 on a lengthwise and crosswise selfadjusting boat support which adapts to contact and movably support the bottom of a boat. A keel roller 132 is spaced forward to contact and support the forward area of the bottom of the boat. Similar to keel roller 70, above, keel roller 132 may be adjusted lengthwise along frame 112, and specifically along frame member 14, to adjust and properly position keel roller 132 for movable support and storage of a particular boat. A length adjustable front leg 134 and a winch 136 are also provided at a front 138 of mooring station 110.

Figure 6:
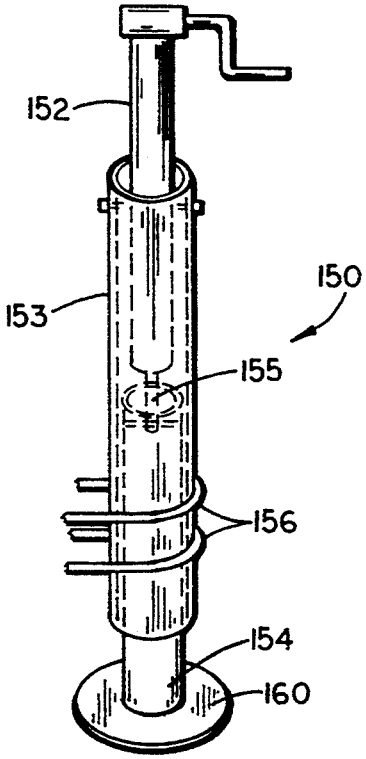
FIG. 6 is a detailed view of a back leg of the mooring station of FIG. 5.

A further modification or alternative embodiment of mooring station 10 may include the use of extensible rear legs 150 (FIGS. 5 and 6), similar to the length adjustable front leg 78. In one embodiment, each rear leg 150 may include an extensible jack member 152 connected by a coupling 153 with a leg extension 154 which extends generally downward from frame 112 for standing support on a lake or river bottom or the like. As shown in FIG. 6, extensible jack member 152 may be any of various trailer or recreational vehicle screw jacks produced by numerous manufacturers and commonly available through trailer and recreational vehicle parts and accessories dealers. Jack member 152 has a telescoping leg 155 which may be pinned or bolted or otherwise connected with leg extension 154 by common methods. Leg extension 154 is preferably an elongated member such as a length of tubing or pipe for example, having cross-sectional shape and dimensions corresponding to those of jack member 152. Thus, coupling 153 may simply be a length of tubing sized for slip-fit engagement over leg extension 154 and jack member 152. Of course, those who practice the invention and those skilled in the art will appreciate the desirability of having the components of legs 150 and the components of either mooring station 10 or 110 being formed of galvanically compatible materials to avoid galvanic corrosion problems. Each rear leg 150 may be connected with frame 112 by "U" bolts 156 and brackets 158. Foot pads 160, which are wider than leg extensions 154 and help support the weight of the mooring station and/or any boat supported thereon on the bottom of the lake or river, are also preferably provided for rear legs 150.

As those who are skilled in the art or will appreciate, extensible rear legs 150 add further flexibility to the utility of mooring station 110 by allowing the user to easily adjust the elevation of the back of the mooring station to accommodate fluctuating water levels and to enhance launching and storage operations by lowering or raising the back of mooring station 110 appropriately. It will further be appreciated that legs 150 of mooring station 110 may, within the scope of this invention, be replaced with a single leg, rather than the two legs described and shown. Similarly, legs 22 of mooring station 10 may also be replaced with a single leg, within the scope of the invention.

As with mooring station 10, described in greater detail above, mooring station 110 is used by floating boat 36 up to the back 164 of mooring station 110 and attaching winch cable and hook 166 to the bow eye of boat 36. Winch 136 is actuated to retrieve cable and hook 166 to pull boat 36 up on to rollers 130 and keel roller 132. Front leg 134 is preferably adjusted to level mooring station 110 while boat 36 is pulled forward, to facilitate winch operation.

Other modifications or variations to the embodiments described will occur to those who are skilled in the art and to those who practice the invention and may include, but not be limited to the following examples:

Frame: Various sizes, shapes and materials may be used to construct frames 12 and 112. Frame 12 may also be two pieces that telescope and pin together.

Roller Assemblies: The roller assembly shown may include rubber rollers, but other composite materials could be used as long as they do not damage the boat bottom, as is well known in the art. The exact location, number of rollers, and number of keel rollers will vary with boat size and weight considerations.

Length Adjustable Legs: The extensible legs may be mechanically, hydraulically, manually, electronically or otherwise operated.

Different Types of Boats: Various boat sizes will require various component part sizes and strengths. The same basic mooring station designs may be used with increasing lengths, cross sections, and winch capacities, and with more roller assemblies as needed for increasing boat length and weight. This invention may also be adapted to various shapes and sizes of boats, such as flat bottom, round bottom, or "V" hull.

The invention will also accommodate pontoon boats by having separate and lengthwise adjustable frames, each with roller systems to support the pontoons. In a pontoon arrangement, the winch will preferably be centrally positioned between two parallel lengthwise frames, to pull the two pontoons onto the rollers and above waterline in a manner similar to that described above.

Thus, this invention solves the problems of poor protection, lack of portability, limited use ability in varying water depth conditions, and difficult handling due to being too heavy that other mooring stations do not solve. The invention is easy to move because of its lightweight, can be disassembled for portability, can be used in a wide range of water depth conditions, and the design accommodates boats of various lengths.

The foregoing description of the preferred embodiments of the invention is presented for illustration and description only. It is not intended to be exhaustive or to limit the invention to the forms disclosed. Many modifications and variations beyond the above examples are possible and will occur to those skilled in the art and to those who practice the invention, in light of the above teaching. The scope of the invention will not, therefore, be limited by this detailed description, but rather is defined by the claims appended hereto.

The embodiments of the invention in which an exclusive property or privilege is claimed are defined as follows.

1. A boat mooring station comprising:

a frame having a frame front and an opposing frame back, having a frame left side and an opposing frame right side, generally positioned above a waterline of a body of water, and oriented generally parallel to the surface of the body of water;

at least one back leg connected with said frame near said frame back, said back leg extending at least generally downward from said frame to stand on a bottom of the body of water and support said frame;

a front leg connected with said frame near said frame front and extending at least downward from said frame, at least one of said back leg and said front leg being an extensible member to rotate said frame between a first position in which said frame is tilted relative to the surface of the body of water and a second position in which said frame is leveled; and a boat support connected with said frame to receive the boat and move the boat relative to said frame, said boat support lifting the boat from a floating position to a storage position, and to launch the boat, said boat support lowering the boat from said storage position to said floating position; said boat support having a first part located nearer said frame front than said frame back to abut a first portion of the underside of the boat, said boat support having a second part spaced from said first part and located near said frame back to abut a second portion of the underside of the boat, whereby the boat moves upon said boat support relative to said frame and said boat support lifts the boat from a floating position to a storage position upon said mooring station with said frame in said second position and whereby the boat moves upon said boat support relative to said frame and said boat support lowers the boat from said storage position to said floating position with said frame in said first position.

2. The boat mooring station defined in claim 1, wherein said boat support includes a plurality of tilt arms, tilting roller arms, and rotatable rollers operably connected with said frame to contact and support varying hull bottom configurations.

3. The boat mooring station defined in claim 1, wherein said frame includes a lengthwise frame member extending between said frame front and said frame back and includes a cross frame member extending between said frame left side and said frame right side, said cross frame member being connected with said lengthwise frame member to define a generally T-shaped frame.

4. The boat mooring station defined in claim 1, wherein said frame includes a first lengthwise frame member having a front end and an opposing back end, includes a second lengthwise frame member having a front end and an opposing back end, and includes a cross frame member extending at least between said first lengthwise frame member and said second lengthwise frame member; wherein said front end of said first lengthwise frame member and said front end of said second lengthwise frame member are connected with one another; and wherein said cross frame member is located nearer said frame back than said frame front.

5. The boat mooring station defined in claim 4, wherein said back end of said first lengthwise frame member and said back end of said second lengthwise frame member are spaced apart from one another and wherein said first lengthwise frame member, said second lengthwise frame member, and said cross frame member define a generally A-shaped frame.

6. The boat mooring station defined in claim 1, wherein said back leg couples with said frame at a range of relative leg lengths to support said frame at said range of various leg lengths above the bottom of the body of water.

7. The boat mooring station defined in claim 1, wherein said back leg is an extensible member to raise and lower said frame back.

8. A boat mooring station comprising:

a frame having first and second opposing ends;

a first leg releasably connected with said frame near said first end, said first leg being adjustable in length between a lowered position to store a boat and a raised position to launch the boat;

second and third legs releasably connected with said frame near said second end, each of said second and third legs having means for positioning said second end of said frame relative to the surface of a body of water; and a boat support connected with said frame to receive the boat in sliding engagement relative to said frame to lift the boat from a floating position to a storage position and to launch the boat from said storage position to said floating position, said boat support having a first part located nearer said first end of said frame than said second end of said frame to abut a first portion of the undersurface of the boat hull, said boat support having a second part spaced from said first part and located near said second end of said frame to abut a second portion of the undersurface of the boat hull, whereby the boat moves upon said boat support relative to said frame and said boat support lifts the boat from a floating position to a storage position upon said mooring station with said first leg being in said lowered position, and whereby the boat moves upon said boat support relative to said frame and said boat support lowers the boat from said storage position to said floating position when said first leg is in said raised position.

9. The boat mooring station defined in claim 8 wherein said frame includes at least two frame members, said two frame members being interconnected by a releasable coupling.

10. The boat mooring station defined in claim 9 wherein said two frame members define a generally T-shaped frame.

11. The boat mooring station defined in claim 9, wherein said frame further includes a third frame member releasably connected with each of said two frame members, said two frame members and said third frame member defining a generally A-shaped frame.

12. The boat mooring station defined in claim 8, wherein each of said second and third legs is adjustable in length.

13. The boat mooring station defined in claim 8, wherein said boat support includes a plurality of tilt arms, tilting roller arms, and rotatable rollers operably connected with said frame to contact and support varying hull bottom configurations.

14. A boat mooring station comprising:

a frame having a frame front end and an opposing frame back end;

a front leg connected with said frame near said frame front end, said front leg being adjustable in length between a first position in which said frame front end is elevated relative to said frame back end and a second position in which said frame front end is at about the same height as said frame back end;

at least one back leg connected with said frame near said frame back end, said back leg having means for positioning said frame back end at various vertical locations;

a back boat support connected with said frame, near said frame back end to abut a portion of the undersurface of a boat and move the boat relative to said frame, said back boat support lifting the boat from a floating position to a storage position; and a front boat support connected with said frame and positioned between said frame front end and said back boat support to abut a portion of the undersurface of the boat and move the boat relative to said frame, said front boat support supporting a forward portion of the boat in the storage position, whereby said front boat support and said back boat support lift and move the boat relative to the frame from a floating position to a storage position upon said mooring station, and whereby said front boat support and said back boat support move and lower the boat relative to said frame to launch the boat from said storage position to said floating position.

15. The boat mooring station defined in claim 14 wherein said frame includes at least two frame members, said two frame members defining a generally T-shaped frame.

16. The boat mooring station defined in claim 14 wherein said frame includes at least three frame members, said three frame members defining a generally A-shaped frame.

17. A method of mooring a boat on a mooring station and launching the boat, comprising the steps of:

providing a mooring station by:

providing a frame to support a boat;

connecting a length adjustable front leg with said frame near a front end of said mooring station;

connecting at least one back leg with said frame near a back end of said mooring station, opposite said front end;

connecting a front boat support with said frame at a position between said front end of said mooring station and said back boat support;

adapting each of said back boat support and said front boat support to abut the bottom of the boat to support the boat and whereby the boat is movable relative to said mooring station;

positioning said mooring station near a shoreline of a body of water with said frame oriented generally horizontally and at least a back portion of said mooring station located over a surface of the body of water;

adjusting said back leg to stand on the bottom of the body of water and support said frame;

floating the boat on the body of water and up to said back end of said mooring station;

engaging each of said back boat support and said front boat support with the undersurface of the boat to move the boat relative to said mooring station and lift the boat from the floating position to a storage position upon said back boat support and said front boat support; and extending said front leg to lift said front end of said mooring station;

moving the boat relative to said mooring station to disengage the boat from each of said front boat support and said back boat support and lower the boat from said storage position to said floating position.

18. The method defined in claim 17 further including the step of adapting said back leg to position said back boat support at a range of vertical locations.

* * * * *